US006759374B2

(12) United States Patent
Milbrath et al.

(10) Patent No.: US 6,759,374 B2
(45) **Date of Patent: *Jul. 6, 2004**

(54) COMPOSITION COMPRISING LUBRICIOUS ADDITIVE FOR CUTTING OR ABRASIVE WORKING AND A METHOD THEREFOR

(75) Inventors: Dean S. Milbrath, Stillwater, MN (US); Mark W. Grenfell, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/956,442

(22) Filed: Sep. 19, 2001

(65) Prior Publication Data

US 2003/0134757 A1 Jul. 17, 2003

(51) Int. Cl.[7] ..... C10M 105/52

(52) U.S. Cl. ..... 508/463; 508/501; 508/577; 508/579; 508/582; 508/590

(58) Field of Search ..... 508/588, 589, 508/590, 463; 72/42

(56) References Cited

U.S. PATENT DOCUMENTS

| | | | | |
|---|---|---|---|---|
| 3,129,182 A | | 4/1964 | McLean | 252/54 |
| 4,084,737 A | * | 4/1978 | Gorman et al. | 225/2 |
| 4,428,851 A | * | 1/1984 | Hisamoto et al. | 72/42 |
| 5,298,083 A | | 3/1994 | Van Der Puy et al. | |
| 5,839,311 A | * | 11/1998 | Grenfell et al. | 72/42 |
| 6,043,201 A | * | 3/2000 | Milbrath et al. | 508/582 |
| 6,294,508 B1 | * | 9/2001 | Milbrath et al. | 508/582 |
| 6,326,338 B1 | * | 12/2001 | Garrett | 508/589 |
| 6,423,673 B1 | * | 7/2002 | Owens et al. | 510/177 |

FOREIGN PATENT DOCUMENTS

| | | |
|---|---|---|
| AU | 718755 | 1/1997 |
| FR | 2 734 576 A1 | 11/1996 |
| GB | 2 216 541 A | 10/1989 |
| WO | 98/12286 | 3/1998 |
| WO | 98/12287 | 3/1998 |
| WO | 99/25516 | 5/1999 |
| WO | WO 00/42118 | 7/2000 |
| WO | 00/56833 | 9/2000 |

OTHER PUBLICATIONS

Technical Information: DuPont, Vertrel® X–B3 Specialty Fluid, "Cutting and Drilling Lubricant Carrier Fluid and Coolant," Dec., 1998, 4 pages.

Article: Childers, "The Chemistry of Metalworking Fluids," *Metal–Working Lubricants*, Jerry P. Byers ed., 1994, pp. 165–189.

Article: Zurer, "Looming Ban on Production of CFCs, Halons Spurs Switch to Substitutes," *Chem & Eng News*, Nov. 15, 1993, pp. 12–18.

Tseregounis, S.I. and Rile, M. J.: Aiche Journal Apr. 1994, vol. 40, No. 4, pp. 726–737.

* cited by examiner

*Primary Examiner*—Ellen M McAvoy

(57) ABSTRACT

The present invention provides a composition for cutting or abrasive working operations that comprises at least one lubricious additive and at least one hydrofluorocarbons. The present invention also provides a method for cutting or abrasive working.

19 Claims, 1 Drawing Sheet

COMPOSITION COMPRISING LUBRICIOUS ADDITIVE FOR CUTTING OR ABRASIVE WORKING AND A METHOD THEREFOR

FIELD OF THE INVENTION

This invention relates to cutting or abrasive working operations, particularly to metal, cermet, or composite cutting or abrasive working operations, and more particularly it relates to working fluids comprising one or more hydrofluorocarbon(s) and one or more specific lubricious additive(s) used in conjunction with these operations.

BACKGROUND OF THE INVENTION

Drilling and machining fluids long have been used in the cutting and abrasive working of metals, cermets, and composites. In these operations, including cutting, milling, drilling, and grinding, the purpose of the working fluid is to lubricate, to cool, and to remove fines, chips and other particulate waste from the working environment. In addition to lubricating and cooling, these working fluids also can prevent welding between a workpiece and tool and can prevent excessively rapid tool wear. See, for example, Jean C. Childers, *The Chemistry of Metalworking Fluids*, in *METAL-WORKING LUBRICANTS* (Jerry P. Byers ed., 1994).

A working fluid ideally suited as a coolant and/or lubricant for cutting and abrasive working of metal, cermet, and composite materials preferably imparts a high degree of lubricity for the duration of the cutting and abrasive working operation. But the working fluid should also preferably possess the added advantage of being an efficient cooling medium that is non-persistent in the environment, is non-corrosive (i.e., is chemically inert), and does not leave a substantial residue on either the workpiece or the tool upon which it is used.

Today's state-of-the-art working fluids generally comprise two categories of materials: (a) oils and other organic chemicals that are derived principally from petroleum, animal, or plant substances; and (b) fluorinated hydrocarbons. The first category, i.e., the oils or other organic chemicals, commonly are used either neat (i.e., without dilution with water or solvent or are compounded with various polar or chemically active additives (e.g., sulfurized, chlorinated, or phosphated additives). These neat or compounded materials are also commonly emulsified to form oil-in-water emulsions. Widely used oils and oil-based substances include the following general classes of compounds: saturated and unsaturated aliphatic hydrocarbons such as mineral oil, turpentine oil, and pine oil; naphthalenic hydrocarbons; and aromatic hydrocarbons. While these oils (and oil derivatives) are widely available and are relatively inexpensive, their utility is significantly limited, as the oils preferably are non-flammable and consequently exhibit low volatility during drilling or machining operations. These low volatility oils tend to leave residues on tools and workpieces, thus requiring additional processing at significant cost to remove the residues. Emulsified materials also leave residues of surfactants and emulsifiers in addition to oily residues on tools and workpieces.

Fluorinated hydrocarbons, the second category of materials for the cutting and abrasive working of metals, cermets, or composites, has generally included the groups of chlorofluorocarbons (CFCs), hydrochlorofluorocarbons (HCFCs), and perfluorocarbons (PFCs). Of these three groups of fluorinated hydrocarbons, CFCs historically are the most useful and the most widely employed. See, e.g., U.S. Pat. No. 3,129,182 (McLean). Then HCFCs were used as lower ozone-depleting potential replacements for CFCs following the Montreal Protocol of 1987. CFCs and HCFCs typically used included trichloromonofluoromethane, 1,1,2-trichloro-1,2,2-trifluoroethane, 1,1,2,2-tetrachlorodifluoroethane, tetrachloromonofluoroethane, and trichlorodifluoroethane. The CFCs and HCFCs generally accepted as most useful from this second category of materials possess many of the characteristics sought in a working fluid. While they were initially believed to be environmentally benign, CFCs and HCFCs are now both known to deplete the ozone layer of the atmosphere (See, e.g., P.S. Zurer, *Looming Ban on Production of CFCs, Halons Spurs Switch to Substitutes*, CHEM. & ENG. NEWS, Nov. 15, 1993, at 12). While PFCs have no ozone depleting potential, they tend to persist in the environment (i.e., they are not chemically altered or degraded under ambient environmental conditions). Also, when used alone, these fluorinated hydrocarbons often do not impart as high a degree of lubricity to cutting or abrasive working operations as do the oils and oil derivatives described in the first category of materials.

Thus, there continues to be a need for a volatile working fluid for use in cutting and abrasive working operations that provides the necessary lubricity for the duration of the operation, but that does not leave a residue on the workpiece. Additionally, this working fluid preferably exhibits low flammability and good environmental properties (i.e., no ozone depleting potential and low global warming potential).

SUMMARY OF THE INVENTION

Briefly, in one aspect, this invention provides a working fluid useful for the cutting and abrasive treating of metal, cermet, and composite materials, wherein the working fluid comprises one or more hydrofluorocarbons (hereinafter referred to as HFCs) and one or more lubricious additives, each additive having a boiling point from about 200° C. to about 350° C. In another aspect, the present invention provides a method of cutting and abrasively treating metal, cermet, and composite materials, comprising applying to the metal, cermet, or composite workpiece and tool a working fluid comprising one or more HFCs and one or more lubricious additives, each additive having a boiling point ranging from about 200° C. to about 350° C.

The working fluids used in the cutting and abrasive treatment of metals, cermets, and composites in accordance with this invention advantageously provide efficient lubricating and cooling media that fit many of the ideal characteristics sought in a working fluid: efficient lubrication, heat transfer properties, and volatility during the duration of the treating operation, non-persistency in the environment, and non-corrosivity. The working fluids also do not leave a substantial residue (preferably no residue) on either the workpiece or the tool upon which they are used, thereby eliminating otherwise necessary processing to clean the tool and/or workpiece for a substantial cost savings. Because these working fluids reduce tool temperature during operation, their use often also enhances tool life. The addition of lubricious additive increases tool/workpiece lubrication, which minimizes the production of heat from friction, further extending tool life and producing better surface finishes on the workpiece.

DETAILED DESCRIPTION OF ILLUSTRATIVE EMBODIMENTS

Figure 1:
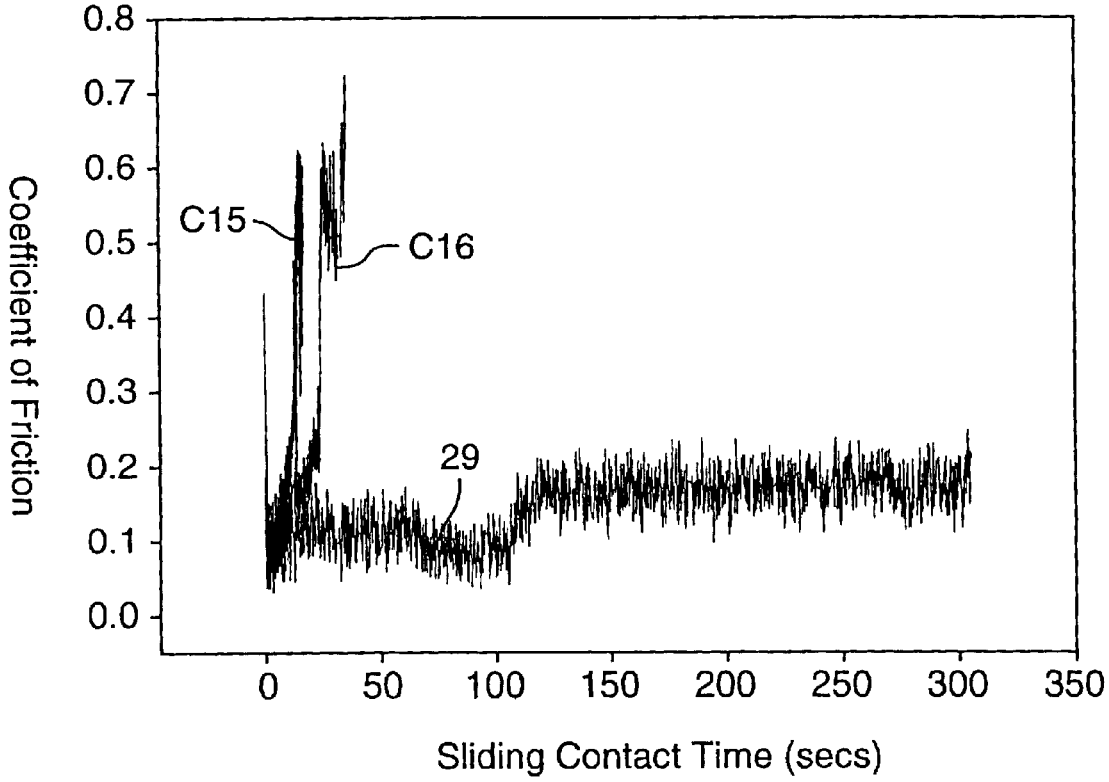
FIG. 1 is a graph of the coefficient of friction versus sliding contact time (sec) for FREON™ TB-1 (Example C15), VERTREL™ XB-3 (Example C16), and ethyl decanoate in $CF_3CHFCHFCF_2CF_3$ (Example 29).

The working fluids of the present invention may be utilized as lubricating and/or cooling fluids in any process involving the cutting or abrasive treatment of any metal, cermet, or composite material (i.e., the workpiece) suitable to these operations. These processes are characterized by the removal of material from the workpiece whose bulk temperature is less than about 80° C., preferably less than about 60° C., during the removal process. Bulk temperature is defined herein as the average integrated temperature of the workpiece.

The most common, representative, processes involving the cutting, separation, or abrasive machining of workpieces include drilling, cutting, punching, milling, turning, boring, planing, broaching, reaming, sawing, polishing, grinding, tapping, trepanning and the like.

Metals commonly subjected to cutting and abrasive working include: refractory metals such as tantalum, niobium, molybdenum, vanadium, tungsten, hafnium, rhenium, and titanium; precious metals such as silver, gold, and platinum; high temperature metals such as nickel, titanium alloys, and nickel chromes; and other metals including magnesium, copper, aluminum, steel (including stainless steels), and other alloys such as brass, and bronze. These working fluids lubricate machining surfaces, resulting in a smooth and substantially residue-free machined workpiece surface. The working fluids of the present invention in these operations also cool the machining environment (i.e., the surface interface between a workpiece and a machining tool) by removing heat and particulate matter therefrom.

Cermets are defined as a semisynthetic-product consisting of a mixture of ceramic and metallic components having physical properties not found solely in either one alone. Examples include, but are not limited to, metal carbides, oxides, and silicides. See Hawley's Condensed Chemical Dictionary, 12$^{th}$ Edition, Van Nostrand Reinhold Company, 1993.

Composites are described herein as laminates of high temperature fibers in a polymer matrix, for example, a glass or a carbon fiber in an epoxy resin.

Hydrofluorocarbon(s)

The working fluids of this invention comprise at least one HFC that contains from 4 to about 8 carbon atoms. Suitable HFCs include the following:

(1) 4-carbon linear or branched HFCs of the formula:

$C_4H_nF_{10-n}$ where $n \leqq 5$;

representative examples of this class are:

| | |
|---|---|
| $CF_3CH_2CF_2CH_3$, | $CF_3CF_2CH_2CH_2F$, |
| $CH_3CF(CHF_2)CHF_2$, | $CF_3CH_2CF_2CH_2F$, |
| $CF_3CH_2CH_2CF_3$, | $CH_2FCF_2CF_2CH_2F_2$, |
| $CHF(CF_3)CF_2CF_3$, | $CHF_2(CF_2)_2CF_2H$, |
| $CH_3CHFCF_2CF_3$, and | $CHF_2CH(CF_3)CF_3$; |

(2) 5-carbon linear or branched HFCs of the empirical formula:

$C_5H_nF_{12-n}$ where $n \leqq 6$;

representative examples of this class are:

| | |
|---|---|
| $CF_3CHFCHFCF_2CF_3$, | $CH_3CHFCF_2CF_2CF_3$, |
| $CF_3CH_2CF_2CH_2CF_3$, | $CF_3CH_2CH_2CF_2CF_3$, |
| $CH_3CF_2CF_2CF_2CF_3$, | $CF_3CH_2CHFCH_2CF_3$, |
| $CF_3CH_2CF_2CH_2CH_2F$, | $CHF_2CF_2CF_2CF_2CF_3$, |
| $CH_3CF(CF_2H)CHFCHF_2$, | $CHF_2CF_2CF(CF_3)_2$; |
| $CH_3CF(CHFCHF_2)CF_3$, | $CH_3CHFCHFCF_2CF_3$, |
| $CH_3CH(CF_2CF_3)CF_3$, | $CF_3CF_2CF_2CH_2CH_3$, |
| $CHF_2CH(CHF_2)CF_2CF_3$, | $CH_2FCF_2CF_2CF_2CF_3$, |
| $CHF_2CF(CHF_2)CF_2CF_3$, and | $CH_3CHFCH_2CF_2CF_3$; |

(3) 6-carbon linear or branched HFCs of the empirical formula:

$C_6H_nF_{14-n}$ where $n \leqq 7$;

representative examples of this class are:

| | |
|---|---|
| $CHF_2(CF_2)_4CF_2H$, $CH_3CF_2CH_2CH_2CF_2CF_3$, | $CH_2CH_2CH_2CF_2CF_2CF_3$, |
| $(CF_3CH_2)_2CHCF_3$, $CH_3CH_2CFHCFHCF_2CF_3$, | $CH_3CHFCF_2CHFCHFCF_3$, |
| $CH_3FCHFCH_2CF_2CHFCF_3$, | $CF_2HCHFCF_2CF_2CHFCF_2H$, |
| $CH_2FCF_2CF_2CF_2CF_2CF_2H$, | $CHF_2CF_2CF_2CF_2CF_2CHF_2$, |
| $CHF_2CF_2CF_2CF_2CF_3$, | $CH_3CH(CHFCH_2CF_3)CF_3$, |
| $CH_3CF(CF_2H)CEFCHFCF_3$, | $CH_3CF(CF_3)CHFCHFCF_3$, |
| $CH_3CF_2CF(CF_3)_2CF_2CH_3$, | $CH_3CF(CF_3)CF_2CF_2CF_3$, |
| $CHF_2CF_2CH(CF_3)CF_2CF_3$, and | $CHF_2CF_2CF(CF_3)CF_2CF_3$; |

(5) 7-carbon linear or branched HFCs of the empirical formula:

$C_7H_nF_{16-n}$ where $n \leqq 8$.

Representative examples of this class are:

| | |
|---|---|
| $CH_3CH_2CH_2CHFCF_2CF_2CF_3$, | $CH_3CHFCH_2CF_2CHFCF_2CF_3$, |
| $CH_3(CF_2)_5CH_3$, | $CH_3CH_2(CF_2)_4CF_3$, |
| $CF_3CH_2CH_2(CF_2)_3CF_3$, | $CH_3FCF_2CHF(CF_2)_3CF_3$, |
| $CF_3CF_2CF_2CCHFCHFCF_2CF_3$, | $CF_3CF_2CF_2CHFCF_2CF_2CF_3$, |
| $CH_3CH_2CH_2CHFCF(CF_3)_2$, | $CH_3CH(CF_3)CF_2CF_2CF_2CH_3$, |
| $CH_3CF(CF_3)CH_2)CFHCF_2CF_3$, | $CH_3CF(CF_2CF_3CHFCF_2CF_3$, |
| $CH_3CH_2CH(CF_3)CF_2CF_2CF_3$, | $CHF_2CF(CF_3)(CF_2)_3CH_2F$, and |
| $CHF_2CF(CF_3)(CF_2)_3CF_3$; | |

(6) 8-carbon linear or branched HFCs of the empirical formula $C_8H_nF_{18-n}$ where $n \leqq 9$;

representative examples of this class are:

| | |
|---|---|
| $CH_3CH_2CH_2CH_2CF_2CF_2CF_2CF_3$, | $CH_3(CF_2)_6CH_3$, |
| $CHF_2CF(CF_3)(CF_2)_4CHF_3$, | $CHF_2CF(CF_3)(CF_2)_4CHF_2$, |
| $CH_3CH_2CH(CF_3)CF_2CF_2CF_2CF_3$, | $CH_3CF(CF_2CF_3)CHFCF_2CF_2CF_3$, |
| $CH_3CF(CF_2CF_3)CHFCF_2CF_2CF_3$, | $CH_3CH_2CH_2CHFC(CF_3)_2CF_3$, |
| $CH_3C(CF_3)_2CF_2CF_2CF_2CH_3$, | $CH_3CH_2CH_2CF(CF_3)CF(CF_3)_2$, and |
| $CH_2FCF_2CF_2CHF(CF_2)_3CF_3$. | |

Preferably, the HFC is selected from linear or branched HFCs having from 4 to 6 carbon atoms. More preferably, the HFC is selected from the group consisting of $CF_3CHFCHFCF_2CF_3$ and $CF_3CH_2CF_2CH_3$.

The HFC can be used alone or as a mixture of two or more HFCs. Alternatively, the HFC(s) can be mixed with another fluorinated solvent, such as a perfluorinated ketone or a hydrofluoroether.

Lubricious Additive(s)

The working fluids of the present invention comprise one or more lubricious additives selected from the group consisting of esters and alkylene glycol ethers having a boiling point ranging from about 200° C. to about 350° C., preferably ranging from about 200° C. to 310° C. These lubricious additive(s) impart lubricity to the operation to minimize galling and increase tool life while improving the surface finish of the machined surface and keeping the tool and workpiece cool during the duration of the cutting or abrasive working operation. Preferably, no residue remains after the machining operation is complete.

The lubricious additive(s) are preferably selected from the group consisting of alkylene glycol ethers, fatty acid esters, and lactic acid esters. More preferably, the alkylene glycol ether is diethylene glycol monobutyl ether, dipropylene glycol t-butyl ether, and/or dipropylene glycol n-butyl ether; the fatty acid ester is ethyl octanoate, ethyl decanoate, ethyl laurate and/or isopropyl myristate; and the lactic acid ester is amyl lactate and/or ethylhexyl lactate.

Generally, concentrations of lubricious additives in the working fluid are about 0.1 to about 30 percent by weight, preferably about 0.1 to about 10 percent, and most preferably about 0.1 to about 5 percent of the total working fluid. The concentration of each lubricious additive is independent, but is limited to a total concentration not to exceed about 30 percent, preferably about 10 weight percent, and most preferably about 5 weight percent of the total working fluid.

The working fluids of the present invention can, and typically include one or more conventional additives such as corrosion inhibitors, antioxidants, defoamers, dyes, bactericides, freezing point depressants, metal deactivators, co-solvents, and the like. The selection of these conventional additives is well known in the art and their application to any given method of cutting and abrasive working is well within the competence of an individual skilled in the art.

The particular selection of the working fluid of the present invention depends upon the workpiece material, the tooling material and design, the method of working fluid application, the amount of working fluid applied, and the processing parameters such as feed rates and tool speeds. All of these parameters are preferably optimized.

The working fluids of the present invention may be applied for the cutting and abrasive working of metals, cermets, or composites using any known technique. For example, the working fluids can be applied in either liquid or aerosol form, can be applied both externally, i.e. supplied to the tool from the outside, or internally (i.e., through suitable feed provided in the tool itself).

The following examples are offered to aid in the understanding of the present invention and are not to be construed as limiting the scope thereof. Unless otherwise indicated, all parts, ratios, and percentages are by weight.

EXAMPLES

Test Method

Coefficient of Friction and Break Time Test Procedure

The following procedure was used to evaluate the coefficient of friction (COF) over time for each test working fluid using cutting conditions for an aluminum workpiece (e.g., speed and pressure).

The test apparatus used was a CETR Microtribometer (available from Center for Tribology, Inc., Mountain View, Calif.) equipped with a 440C steel ball of 9.5 mm diameter and a 2024 aluminum disk of 6.25 cm diameter. Prior to testing, the disk was polished using a Buehler metallographic grinding/polishing unit (available from Buehler, Inc., Lake Bluff, Ill.) equipped with 400 grit abrasive paper. The disk was mounted on the turntable of the tribometer and the ball was mounted in a fixture such that the ball was stationary. Each test was run at a constant velocity of 125,600 mm/min at the ball and a load of 5 Newtons on the ball. The load was applied for the first 5 seconds of the test and was then held at 5 Newtons over the next 15 seconds. The lateral and downward force values were recorded over time using the load cell of the microtribometer, and the COF was calculated for each instant of time by dividing the lateral force by the downward force. For each test, the working fluid was applied to the center of the spinning disk at a rate of about 20 mL/min using a syringe. The fixed steel ball was then moved into contact with the disk, and working fluid flow was stopped when the downward force exceeded about 1 Newton as indicated by the instrument. Each test in a series was run at a new position on the same disk and at a new sector of the steel ball. Also, each working fluid was tested in triplicate, with the average COF values recorded. The COF values were also plotted as a function of time. The "break time" was defined as that time when the COF suddenly begins to dramatically increase with time. Working fluids that never impart low COFs (i.e., COFs greater or equal to 0.5) were assigned a break time of zero. Those working fluids that did not exhibit a COF break during the course of the experiment were assigned a break time of >20 seconds.

It is desirable that the COF value is below about 0.3 and the break time is at least 15 seconds.

Examples 1–8 and Comparative Example C1–C7

Using the Coefficient of Friction and Break Time Test Procedure, COF values and break times were determined for a series of working fluids containing 2% lubricious additive and 98% $CF_3CHFCHFCF_2CF_3$ (an HFC, available as VERTREL™ XF from E. I. duPont de Nemours & Co., Wilmington, Del.). The lubricious additives were ethylene glycol ethers, propylene glycol ethers, fatty acid esters or lactic acid esters having various boiling points (b.p.), all available from Sigma-Aldrich Chemical Company, Milwaukee, Wis.

Results are presented in TABLE 1.

TABLE 1

| Lubricious Additive: | | | | COF | |
|---|---|---|---|---|---|
| Ex. | Name | Class | b.p. (° C.) | Value | Break Time (sec) |
| 1 | Diethylene Glycol n-Butyl Ether | Alkylene | 230 | 0.115 | >20 |
| C1 | Ethylene Glycol n-Butyl Ether | Glycol Ether | 171 | 0.390 | 9.5 |
| C2 | Ethylene Glycol Methyl Ether | | 124 | 0.503 | 0 |
| 2 | Dipropylene Glycol n-Butyl Ether | | 212 | 0.113 | >20 |
| 3 | Dipropylene Glycol t-Butyl Ether | | 212 | 0.145 | >20 |
| C3 | Propylene Glycol n-Butyl Ether | | 170 | 0.524 | 4.3 |
| C4 | Propylene Glycol t-Butyl Ether | | 153 | 0.590 | 0 |
| 4 | Ethyl Laurate | Fatty Acid | 269 | 0.084 | >20 |
| 5 | Ethyl Decanoate | Ester | 245 | 0.131 | >20 |
| 6 | Ethyl Octanoate | | 207 | 0.077 | >20 |
| C5 | Ethyl Hexanoate | | 168 | 0.689 | 0 |
| 7 | Ethylhexyl Lactate | Lactic Acid | 247 | 0.282 | 16.7 |
| 8 | Amyl Lactate | Ester | 207 | 0.253 | 15.9 |
| C6 | Ethyl Lactate | | 154 | 0.535 | 0 |
| C7 | Methyl Lactate | | 144 | 0.565 | 0 |

The data in TABLE 1 show that the lubricious additives having a boiling point of than 200° C. produced a maximum COF value of 0.282 (with most COF values below 0.15) and exhibited break times of at least 15 seconds (with most break times greater than 20 seconds). In contrast, the lubricious additives having a boiling point of less than 200° C. produced a minimum COF value of 0.390 and exhibited a maximum break time of 9.5 seconds.

Examples 9–16 and Comparative Example C8–C12

Using the Coefficient of Friction and Break Time Test Procedure, COF values and break times were determined for a series of working fluids containing 2% lubricious additive and 98% HFC. The lubricious additives were ethylene glycol ethers, propylene glycol ethers, fatty acid esters or lactic acid esters having various boiling points (b.p.). This time the HFC used was a 60/40 blend of $CF_3CHFCHFCF_2CF_3$ and $CF_3CH_2CF_2CH_3$ (available as SOLKANE™ 365 mfc from Solvay Societe Anonyme, Brussels, Belgium).

Results are presented in TABLE 2.

The data in TABLE 2 show that the lubricious additives having a boiling point of greater than 200° C. produced a maximum COF value of 0.258 (with most COF values below 0.15) and exhibited break times of at least 16 seconds (with most break times greater than 20 seconds). In contrast, the lubricious additives having a boiling point of less than 200° C. produced a minimum COF value of 0.33 and exhibited a maximum break time of about 12 seconds.

Examples 17–18 and Comparative Examples C13–C14

Using the Coefficient of Friction and Break Time Test Procedure, COF values and break times were measured for working fluids both inside (ethyl octanoate/$CF_3CHFCHFCF_2CF_3$) and outside (ethyl hexanoate/$CF_3CHFCHFCF_2CF_3$) of this invention. Each working fluid was run at two different concentrations (%) of lubricious additive. Results are presented in TABLE 3.

TABLE 2

| Lubricious Additive: | | | | COF | |
|---|---|---|---|---|---|
| Ex. | Name | Class | b.p. (° C.) | Value | Break Time (sec) |
| 9 | Diethylene Glycol n-Butyl Ether | Alkylene | 230 | 0.084 | >20 |
| C8 | Ethylene Glycol n-Butyl Ether | Glycol Ether | 171 | 0.33 | 12.1 |
| 10 | Dipropylene Glycol n-Butyl Ether | | 212 | 0.114 | >20 |
| 11 | Dipropylene Glycol t-Butyl Ether | | 212 | 0.118 | >20 |
| C9 | Propylene Glycol n-Butyl Ether | | 170 | 0.389 | 9.0 |
| C10 | Propylene Glycol t-Butyl Ether | | 153 | 0.549 | 0 |
| 12 | Ethyl Laurate | Fatty Acid | 269 | 0.113 | >20 |
| 13 | Ethyl Decanoate | Ester | 245 | 0.111 | >20 |
| 14 | Ethyl Octanoate | | 207 | 0.084 | >20 |
| C11 | Ethyl Hexanoate | | 168 | 0.526 | 0 |
| 15 | Ethylhexyl Lactate | Lactic Acid | 247 | 0.209 | 18.7 |
| 16 | Amyl Lactate | Ester | 207 | 0.258 | 16.3 |
| C12 | Ethyl Lactate | | 154 | 0.514 | 0 |

TABLE 3

| Lubricious Additive: | | | | |
|---|---|---|---|---|
| Ex. | Name | Conc. (%) | COF Value | Break Time (sec) |
| 17 | Ethyl Octanoate | 1 | 0.235 | 15.8 |
| 18 | | 2 | 0.077 | >20 |
| C13 | Ethyl Hexanoate | 2 | 0.689 | 0 |
| C14 | | 3 | 0.498 | 1.8 |

The data in TABLE 3 show that ethyl octanoate (b.p.=207° C.) used at only 1% concentration outperformed ethyl hexanoate (b.p.=168° C.) used at 3% concentration, as ethyl octanoate produced a lower COF value and higher break time. The examples also show that the concentration of the lubricious additive affect the COF value and break time.

Comparative Examples C15–C16

Using the Coefficient of Friction and Break Time Test Procedure, COF values and break times were determined for two commercial volatile working fluids, FREON™ TB-1 (as referenced in U.S. Pat. No. 3,129,182 (McLean)), 1.5% ethylene glycol n-butyl ether in 1,1,2-trichloro-1,2,2-trifluoroethane, available from E. I. duPont de Nemours & Co.) and VERTREL™ XB-3 (shown in E. I. deNemours literature as 3% ethylene glycol n-butyl ether in $CF_3CHFCHFCF_2CF_3$).

Results are shown in TABLE 4.

TABLE 4

| Working Fluid: | | | | |
|---|---|---|---|---|
| Ex. | Name | b.p. (° C.) | COF Value | Break Time (sec) |
| C15 | FREON ™ TB-1 | 171* | 0.309 | 13.4 |
| C16 | VERTREL ™ XB-3 | 171* | 0.150 | 18.3 |

*The boiling point of ethylene glycol n-butyl ether, the lubricious additive component The data in TABLE 4 show that the lubricating performance of the commercial working fluids is inferior to the performance of the working fluids of this invention (please refer to TABLES 1 and 2). VERTREL™ XB-3 produced a low COF and higher break time than C-1, but the lubricious additive concentration differs.

Examples 19–21

Using the Coefficient of Friction and Break Time Test Procedure, COF values and break times were measured for a series of working fluids consisting of 2% ethyl decanoate in HFC, where the HFC consisted of various ratios of $CF_3CHFCHFCF_2CF_3/CF_3CH_2CF_2CH_3$ varying from 100/0 to 50/50.

Results are presented in TABLE 5.

TABLE 5

| | % of HFC: | | COF | |
|---|---|---|---|---|
| Ex. | $CF_3CHFCHFCF_2CF_3$ | $CF_3CH_2CF_2CH_3$ | Value | Break Time (sec) |
| 5 | 100 | 0 | 0.131 | >20 |
| 19 | 80 | 20 | 0.116 | >20 |
| 20 | 60 | 40 | 0.111 | >20 |
| 21 | 50 | 50 | 0.093 | >20 |

The data in TABLE 5 show that very low COF values and excellent break times resulted with all ratios of $CF_3CHFCHFCF_2CF_3$ to $CF_3CH_2CF_2CH_3$ tested.

Examples 22–28 and Comparative Examples C17–C21

Using the Coefficient of Friction and Break Time Test Procedure, COF values and break times were measured for a series of working fluids consisting of various lubricious additives dissolved at 2% in an 80/20 blend of 1,1,1,3,3-pentafluorobutane, an HFC, and $CF_3CF_2C(O)CF(CF_3)_2$, a perfluoroketone. The perfluoroketone was added to render the working fluid non-flammable.

Results are presented in TABLE 6.

TABLE 6

| | Lubricious additive: | | | COF | |
|---|---|---|---|---|---|
| Ex. | Name | Class | b.p. (° C.) | Value | Break Time (sec) |
| 22 | Diethylene Glycol n-Butyl Ether | Alkylene | 230 | 0.116 | >20 |
| C17 | Ethylene Glycol n-Butyl Ether | Glycol Ether | 171 | 0.110 | >20 |
| 23 | Dipropylene Glycol n-Butyl Ether | | 212 | 0.104 | >20 |
| 24 | Dipropylene Glycol t-Butyl Ether | | 212 | 0.105 | >20 |
| C18 | Propylene Glycol n-Butyl Ether | | 170 | 0.161 | 18.9 |
| C19 | Propylene Glycol t-Butyl Ether | | 153 | 0.480 | 1.5 |
| 25 | Ethyl Laurate | Fatty Acid | 269 | 0.064 | >20 |
| 26 | Ethyl Decanoate | Ester | 245 | 0.064 | >20 |
| 27 | Ethyl Octanoate | | 207 | 0.073 | >20 |
| C20 | Ethyl Hexanoate | | 168 | 0.552 | 0 |
| 28 | Ethylhexyl Lactate | Lactic Acid | 247 | 0.182 | >20 |
| C21 | Ethyl Lactate | Ester | 154 | 0.615 | 0 |

The data in TABLE 6 show that consistently low COF values and high break times were obtained with the lubricious additives having boiling points above 200° C.

Example 29

As many previously tested working fluids of this invention gave a break time of greater than 20 seconds, the time period of the COF testing for the working fluid of Example 5 (i.e., 2% ethyl decanoate in $CF_3CHFCHFCF_2CF_3$) was extended to 300 seconds. Even after 300 seconds, the average COF value was 0.148 and no break time was observed.

The actual recorded testing results for Example 29 and Comparative Examples C15–C16 (FREON™ TB-1 and VERTREL™ XB-3, respectively, from TABLE 3) are presented in FIG. 1. The graphs in FIG. 1 illustrate the dramatic improvement in break time shown by working fluid of Example 5 (a working fluid of this invention) vs. the state of-the-art working fluids of Comparative Examples C15–C16.

Various modifications and alterations of this invention will be apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims as set forth herein as follows.

What is claimed is:

1. A working fluid comprising one or more hydrofluorocarbon and one or more lubricious additive, said lubricious additive having a boiling point ranging from about 200° C. to about 350° C.

2. The working fluid according to claim 1, wherein said hydrofluorocarbon has from 4 to about 8 carbon atoms.

3. The working fluid according to claim 2, wherein said hydrofluorocarbon is selected from the group consisting of:

| | |
|---|---|
| $CF_3CH_2CF_2CH_3$, | $CF_3CF_2CH_2CH_2F$, |
| $CH_3CF(CHF_2)CHF_2$, | $CF_3CH_2CF_2CH_2F$, |
| $CF_3CH_2CH_2CF_3$, | $CH_2FCF_2CF_2CH_2F_2$, |
| $CHF(CF_3)CF_2CF_3$, | $CHF_2(CF_2)_2CF_2H$, |
| $CH_3CHFCF_2CF_3$, | $CHF_2CH(CF_3)CF_3$, |
| $CF_3CHFCHFCF_2CF_3$, | $CH_3CHFCF_2CF_2CF_3$, |
| $CF_3CH_2CF_2CH_2CF_3$, | $CF_3CH_2CH_2CF_2CF_3$, |
| $CH_3CF_2CF_2CF_2CF_3$, | $CF_3CH_2CHFCH_2CF_3$, |
| $CF_3CH_2CF_2CH_2CH_2F$, | $CHF_2CF_2CF_2CF_2CF_3$, |
| $CH_3CF(CF_2H)CHFCHF_2$, | $CHF_2CF_2CF(CF_3)_2$, |
| $CH_3CF(CHFCHF_2)CF_3$, | $CH_3CHFCHFCF_2CF_3$, |
| $CH_3CH(CF_2CF_3)CF_3$, | $CF_3CF_2CF_2CH_2CH_3$, |
| $CHF_2CH(CHF_2)CF_2CF_3$, | $CH_2FCF_2CF_2CF_2CF_3$, |
| $CHF_2CF(CHF_2)CF_2CF_3$, | $CH_3CHFCH_2CF_2CF_3$ |
| $CHF_2(CF_2)_4CF_2H$, | $CH_3CF_2CH_2CH_2CF_2CF_3$, |
| $CH_2CH_2CH_2CF_2CF_2CF_3$, | $(CF_3CH_2)_2CHCF_3$, |
| $CH_3CH_2CFHCFHCF_2CF_3$, | $CH_3CHFCF_2CHFCHFCF_3$, |
| $CH_3FCHFCH_2CF_2CHFCF_3$, | $CF_2HCHFCF_2CF_2CHFCF_2H$, |
| $CH_2FCF_2CF_2CF_2CF_2CF_2H$, | $CHF_2CF_2CF_2CF_2CF_2CHF_2$, |
| $CHF_2CF_2CF_2CF_2CF_3$, | $CH_3CH(CHFCH_2CF_3)CF_3$, |
| $CH_3CF(CF_2H)CEFCHFCF_3$, | $CH_3CF(CF_3)CHFCHFCF_3$, |
| $CH_3CF_2CF(CF_3)_2CF_2CH_3$, | $CH_3CF(CF_3)CF_2CF_2CF_3$, |
| $CHF_2CF_2CH(CF_3)CF_2CF_3$, | $CHF_2CF_2CF(CF_3)CF_2CF_3$, |
| $CH_3CH_2CH_2CHFCF_2CF_2CF_3$, | $CH_3CHFCH_2CF_2CHFCF_2CF_3$, |
| $CH_3(CF_2)_5CH_3$, | $CH_3CH_2(CF_2)_4CF_3$, |
| $CF_3CH_2CH_2(CF_2)_3CF_3$, | $CH_2FCF_2CHF(CF_2)_3CF_3$, |
| $CF_3CF_2CF_2CCHFCHFCF_2CF_3$, | $CF_3CF_2CF_2CHFCF_2CF_2CF_3$, |
| $CH_3CH_2CH_2CHFCF(CF_3)_2$, | $CH_3CH(CF_3)CF_2CF_2CF_2CH_3$, |
| $CH_3CF(CF_3)CH_2)CFHCF_2CF_3$, | $CH_3CF(CF_2CF_3CHFCF_2CF_3$, |
| $CH_3CH_2CH(CF_3)CF_2CF_2CF_3$, | $CHF_2CF(CF_3)(CF_2)_3CH_2F$, |

-continued

| | |
|---|---|
| $CHF_2CF(CF_3)(CF_2)_3CF_3$, | $CH_3CH_2CH_2CH_2CF_2CF_2CF_2CF_3$, |
| $CH_3(CF_2)_6CH_3$, | $CHF_2CF(CF_3)(CF_2)_4CHF_3$, |
| $CHF_2CF(CF_3)(CF_2)_4CHF_2$, | $CH_3CH_2CH(CF_3)CF_2CF_2CF_2CF_3$, |
| $CH_3CF(CF_2CF_3)CHFCF_2CF_2CF_3$, | $CH_3CF(CF_2CF_3)CHFCF_2CF_2CF_3$, |
| $CH_3CH_2CH_2CHFC(CF_3)_2CF_3$, | $CH_3C(CF_3)_2CF_2CF_2CF_2CH_3$, |
| $CH_3CH_2CH_2CF(CF_3)CF(CF_3)_2$, and | |
| $CH_2FCF_2CF_2CHF(CF_2)_3CF_3$. | |

4. The working fluid according to claim 1, wherein said hydrofluorocarbon is selected from linear or branched hydrofluorocarbons having from 4 to 6 carbon atoms.

5. The working fluid according to claim 1, wherein said hydrofluorocarbon is selected from the group consisting of $CF_3CHFCHFCF_2CF_3$ and $CF_3CH_2CF_2CH_3$.

6. The working fluid according to claim 1, further comprising a perfluorinated ketone.

7. The working fluid according to claim 1, further comprising a hydrofluoroether.

8. The working fluid according to claim 1, wherein said lubricious additive is selected from the group consisting of esters, alkylene glycol ethers, and mixtures thereof.

9. The working fluid according to claim 8, wherein said esters are selected from the group consisting of fatty acid esters and lactic acid esters.

10. The working fluid according to claim 9, wherein said fatty acid esters are selected from the group consisting of ethyl octanoate, ethyl decanoate, ethyl laurate, isopropyl myristate, and mixtures thereof.

11. The working fluid according to claim 9, wherein said lactic acid esters are selected from the group consisting of amyl lactate, ethylhexyl lactate, and mixtures thereof.

12. The working fluid according to claim 8, wherein said alkylene glycol ether is selected from the group consisting of diethylene glycol monobutyl ether, dipropylene glycol t-butyl ether, dipropylene glycol n-butyl ether, and mixtures thereof.

13. The working fluid according to claim 1, wherein said lubricious additive has a boiling point ranging from about 200° C. to about 310° C.

14. The working fluid according to claim 1, wherein said lubricious additive comprises about 0.1 to about 30 percent by weight of the total working fluid.

15. A process for metal, cermet, or composite working, wherein a working fluid is applied during processing, and wherein said working fluid comprises one or more hydrofluorocarbon and one or more lubricious additive, said lubricious additive having a boiling point ranging from about 200° C. to about 350° C.

16. The process for metal, cermet, or composite working according to claim 15, wherein hydrofluorocarbon is selected from the group consisting of:

| | |
|---|---|
| $CF_3CH_2CF_2CH_3$, | $CF_3CF_2CH_2CH_2F$, |
| $CH_3CF(CHF_2)CHF_2$, | $CF_3CH_2CF_2CH_2F$, |
| $CF_3CH_2CH_2CF_3$, | $CH_2FCF_2CF_2CH_2F_2$, |
| $CHF(CF_3)CF_2CF_3$, | $CHF_2(CF_2)_2CF_2H$, |
| $CH_3CHFCF_2CF_3$, | $CHF_2CH(CF_3)CF_3$ |
| $CF_3CHFCHFCF_2CF_3$, | $CH_3CHFCF_2CF_2CF_3$, |
| $CF_3CH_2CF_2CH_2CF_3$, | $CF_3CH_2CH_2CF_2CF_3$, |
| $CH_3CF_2CF_2CF_2CF_3$, | $CF_3CH_2CHFCH_2CF_3$, |
| $CF_3CH_2CF_2CH_2CH_2F$, | $CHF_2CF_2CF_2CF_2CF_3$, |
| $CH_3CF(CF_2H)CHFCHF_2$, | $CHF_2CF_2CF(CF_3)_2$, |
| $CH_3CF(CHFCHF_2)CF_3$, | $CH_3CHFCHFCF_2CF_3$, |
| $CH_3CH(CF_2CF_3)CF_3$, | $CF_3CF_2CF_2CH_2CH_3$, |
| $CHF_2CH(CHF_2)CF_2CF_3$, | $CH_2FCF_2CF_2CF_2CF_3$, |
| $CHF_2CF(CHF_2)CF_2CF_3$, | $CH_3CHFCH_2CF_2CF_3$ |
| $CHF_2(CF_2)_4CF_2H$, | $CH_3CF_2CH_2CH_2CF_2CF_3$, |
| $CH_2CH_2CH_2CF_2CF_2CF_3$, | $(CF_3CH_2)_2CHCF_3$, |
| $CH_3CH_2CFHCFHCF_2CF_3$, | $CH_3CHFCF_2CHFCHFCF_3$, |
| $CH_3FCHFCH_2CF_2CHFCF_3$, | $CF_2HCHFCF_2CF_2CHFCF_2H$, |
| $CH_2FCF_2CF_2CF_2CF_2CF_2H$, | $CHF_2CF_2CF_2CF_2CF_2CHF_2$, |
| $CHF_2CF_2CF_2CF_2CF_3$, | $CH_3CH(CHFCH_2CF_3)CF_3$, |
| $CH_3CF(CF_2H)CEFCHFCF_3$, | $CH_3CF(CF_3)CHFCHFCF_3$, |
| $CH_3CF_2CF(CF_3)_2CF_2CH_3$, | $CH_3CF(CF_3)CF_2CF_2CF_3$, |
| $CHF_2CF_2CH(CF_3)CF_2CF_3$, | $CHF_2CF_2CF(CF_3)CF_2CF_3$, |
| $CH_3CH_2CH_2CHFCF_2CF_2CF_3$, | $CH_3CHFCH_2CF_2CHFCF_2CF_3$, |
| $CH_3(CF_2)_5CH_3$, | $CH_3CH_2(CF_2)_4CF_3$, |
| $CF_3CH_2CH_2(CF_2)_3CF_3$, | $CH_2FCF_2CHF(CF_2)_3CF_3$, |
| $CF_3CF_2CF_2CCHFCHFCF_2CF_3$, | $CF_3CF_2CF_2CHFCF_2CF_2CF_3$, |
| $CH_3CH_2CH_2CHFCF(CF_3)_2$, | $CH_3CH(CF_3)CF_2CF_2CF_2CH_3$, |
| $CH_3CF(CF_3)CH_2)CFHCF_2CF_3$, | $CH_3CF(CF_2CF_3CHFCF_2CF_3$, |
| $CH_3CH_2CH(CF_3)CF_2CF_2CF_3$, | $CHF_2CF(CF_3)(CF_2)_3CH_2F$, |

-continued

| | |
|---|---|
| $CHF_2CF(CF_3)(CF_2)_3CF_3$, | $CH_3CH_2CH_2CH_2CF_2CF_2CF_2CF_3$, |
| $CH_3(CF_2)_6CH_3$, | $CHF_2CF(CF_3)(CF_2)_4CHF_3$, |
| $CHF_2CF(CF_3)(CF_2)_4CHF_2$, | $CH_3CH_2CH(CF_3)CF_2CF_2CF_2CF_3$, |
| $CH_3CF(CF_2CF_3)CHFCF_2CF_2CF_3$, | $CH_3CF(CF_2CF_3)CHFCF_2CF_2CF_3$, |
| $CH_3CH_2CH_2CHFC(CF_3)_2CF_3$, | $CH_3C(CF_3)_2CF_2CF_2CF_2CH_3$, |
| $CH_3CH_2CH_2CF(CF_3)CF(CF_3)_2$, and | |
| $CH_2FCF_2CF_2CHF(CF_2)_3CF_3$. | |

-continued

| | |
|---|---|
| $CHF_2CF(CHF_2)CF_2CF_3$, | $CH_3CHFCH_2CF_2CF_3$, |
| $CHF_2(CF_2)_4CF_2H$, | $CH_3CF_2CH_2CH_2CF_2CF_3$, |
| $CH_2CH_2CH_2CF_2CF_2CF_3$, | $(CF_3CH_2)_2CHCF_3$, |
| $CH_3CH_2CFHCFHCF_2CF_3$, | $CH_3CHFCF_2CHFCHFCF_3$, |
| $CH_3FCHFCH_2CF_2CHFCF_3$, | $CF_2HCHFCF_2CF_2CHFCF_2H$, |
| $CH_2FCF_2CF_2CF_2CF_2CF_2H$, | $CHF_2CF_2CF_2CF_2CF_2CHF_2$, |
| $CHF_2CF_2CF_2CF_2CF_3$, | $CH_3CH(CHFCH_2CF_3)CF_3$, |
| $CH_3CF(CF_2H)CEFCHFCF_3$, | $CH_3CF(CF_3)CHFCHFCF_3$, |
| $CH_3CF_2CF(CF_3)_2CF_2CH_3$, | $CH_3CF(CF_3)CF_2CF_2CF_3$, |
| $CHF_2CF_2CH(CF_3)CF_2CF_3$, | $CHF_2CF_2CF(CF_3)CF_2CF_3$, |
| $CH_3CH_2CH_2CHFCF_2CF_2CF_3$, | $CH_3CHFCH_2CF_2CHFCF_2CF_3$, |
| $CH_3(CF_2)_5CH_3$, | $CH_3CH_2(CF_2)_4CF_3$, |
| $CF_3CH_2CH_2(CF_2)_3CF_3$, | $CH_2FCF_2CHF(CF_2)_3CF_3$, |
| $CF_3CF_2CF_2CCHFCHFCF_2CF_3$, | $CF_3CF_2CF_2CHFCF_2CF_2CF_3$, |
| $CH_3CH_2CH_2CHFCF(CF_3)_2$, | $CH_3CH(CF_3)CF_2CF_2CF_2CH_3$, |
| $CH_3CF(CF_3)CH_2)CFHCF_2CF_3$, | $CH_3CF(CF_2CF_3CHFCF_2CF_3$, |
| $CH_3CH_2CH(CF_3)CF_2CF_2CF_3$, | $CHF_2CF(CF_3)(CF_2)_3CH_2F$, |
| $CHF_2CF(CF_3)(CF_2)_3CF_3$, | $CH_3CH_2CH_2CH_2CF_2CF_2CF_2CF_3$, |
| $CH_3(CF_2)_6CH_3$, | $CHF_2CF(CF_3)(CF_2)_4CHF_3$, |
| $CHF_2CF(CF_3)(CF_2)_4CHF_2$, | $CH_3CH_2CH(CF_3)CF_2CF_2CF_2CF_3$, |
| $CH_3CF(CF_2CF_3)CHFCF_2CF_2CF_3$, | $CH_3CF(CF_2CF_3)CHFCF_2CF_2CF_3$, |

-continued

| | |
|---|---|
| $CH_3CH_2CH_2CHFC(CF_3)_2CF_3$ , | $CH_3C(CF_3)_2CF_2CF_2CF_2CH_3$, |
| $CH_3CH_2CH_2CF(CF_3)CF(CF_3)_2$, and | |
| $CH_2FCF_2CF_2CHF(CF_2)_3CF_3$. | |

17. The process for metal, cermet, or composite working according to claim 15, wherein said hydrofluorocarbon is selected from linear or branched hydrofluorocarbons having from 4 to 6 carbon atoms.

18. The process for metal, cermet, or composite working according to claim 15, wherein said lubricious additive is selected from the group consisting of esters, alkylene glycol ethers, and mixtures thereof.

19. The process for metal, cermet, or composite working according to claim 18, wherein said esters are fatty acid esters.

* * * * *

UNITED STATES PATENT AND TRADEMARK OFFICE

CERTIFICATE OF CORRECTION

PATENT NO. : 6,759,374 B2
DATED : July 6, 2004
INVENTOR(S) : Milbrath, Dean S.

It is certified that error appears in the above-identified patent and that said Letters Patent is hereby corrected as shown below:

Title page,
Item [56], References Cited, OTHER PUBLICATIONS,
"Article by Tseregounis", reference, after "M. J." delete ":", insert in place thereof -- ; --, and delete "Aiche", insert in place thereof -- AICHE --;

Column 4,
Line 22, after "$CHF_2CF_2CF(CF_3)_2$" delete ";", insert in place thereof -- , --;

Column 7,
Line 25, after "of" insert -- greater --;

Column 11,
Line 54, after "$CH_2CHFCH_2CF_2CF_3$" insert -- , --;

Column 12,
Line 59, after "$CHF_2CH(CF_3)CF_3$" insert -- , --.

Signed and Sealed this

Twenty-sixth Day of April, 2005

JON W. DUDAS
*Director of the United States Patent and Trademark Office*